US009267376B2

(12) United States Patent
Arnot et al.

(10) Patent No.: US 9,267,376 B2
(45) Date of Patent: Feb. 23, 2016

(54) MANUFACTURE OF CABLE BOLTS

(71) Applicant: FCI Holdings Delaware, Inc., Wilmington, DE (US)

(72) Inventors: Jeremy Ross Arnot, Mt Hunter (AU); Kenneth Sargood, Harrington Park (AU)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 13/852,503

(22) Filed: Mar. 28, 2013

(65) Prior Publication Data

US 2014/0119840 A1 May 1, 2014

(30) Foreign Application Priority Data

Apr. 2, 2012 (AU) ..... 2012901303

(51) Int. Cl.

| | |
|---|---|
| ***E21D 21/00*** | (2006.01) |
| ***B21F 9/00*** | (2006.01) |
| ***B21F 11/00*** | (2006.01) |
| ***B21F 15/00*** | (2006.01) |

(52) U.S. Cl.

CPC ..... *E21D 21/0026* (2013.01); *B21F 9/00* (2013.01); *B21F 11/00* (2013.01); *B21F 15/00* (2013.01); *D07B 7/187* (2015.07); *E21D 2021/006* (2013.01)

(58) Field of Classification Search

CPC ..... E21D 21/0026; E21D 2021/006; B21F 9/00; B21F 11/00; B21F 15/00; D07B 7/187

USPC ..... 140/105, 118, 120, 33; 405/259.1

See application file for complete search history.

(56) References Cited

U.S. PATENT DOCUMENTS

| | | | | |
|---|---|---|---|---|
| 3,749,140 | A | 7/1973 | Debry | |
| 4,469,756 | A * | 9/1984 | Jungwirth et al. | 428/592 |
| 5,344,256 | A | 9/1994 | Hedrick | |
| 5,560,740 | A * | 10/1996 | Castle et al. | 405/259.6 |
| 6,561,721 | B2 * | 5/2003 | Lausch et al. | 403/282 |
| 6,820,657 | B1 | 11/2004 | Hedrick | |
| 7,648,311 | B2 * | 1/2010 | Hedrick | 405/259.1 |
| 8,322,950 | B2 * | 12/2012 | Craig | E21D 21/0046 405/259.5 |
| 2006/0054748 | A1 | 3/2006 | Rataj et al. | |
| 2006/0180230 | A1 | 8/2006 | Steains | |
| 2011/0259072 | A1 | 10/2011 | Evans et al. | |

FOREIGN PATENT DOCUMENTS

| | | | |
|---|---|---|---|
| AU | 658972 | B | 8/1993 |
| AU | 2004260817 | B2 | 2/2005 |
| AU | 2008200918 | A1 | 9/2008 |
| WO | 9315279 | A1 | 8/1993 |

* cited by examiner

*Primary Examiner* — Benjamin Fiorello
(74) *Attorney, Agent, or Firm* — The Webb Law Firm

(57) ABSTRACT

A cable bolt comprising a plurality of flexible steel filaments formed around a central member, the cable bolt having spaced bulbous portions along the length of the bolt each bulbous portion defining a cavity containing a segmented ring that surrounds the central member to engage the filaments of the bulbous portion.

5 Claims, 5 Drawing Sheets

MANUFACTURE OF CABLE BOLTS

TECHNICAL FIELD

This invention relates to cable for use in strata control, especially to reinforce the roof and/or walls of underground mines and tunnels, to methods of manufacturing cable bolts and to manufacturing components and systems used in such methods.

BACKGROUND

Cable bolts are usually made from cable comprising a plurality of steel filaments wound together around a central wire to form a tendon. Resin and/or cement grout is used to fix the cable bolt to a borehole. To increase the effective bond strength between the cable bolt and resin or grout the bolts are often provided with spaced protuberances along the length of the cable. These protuberances are often known as bulbs or cages. The protuberances assist in preventing cable bolts from being pulled through the resin or grout, thus providing improved anchorage and load transfer between the cable, resin/grout and the surrounding strata.

It is known that tensioning of the cable prior to cement grouting can cause the protuberance to collapse thus reducing the cable's effectiveness. In Australian patent 2004260817 there is a proposal to insert ball bearings into the cavities defined by the protuberances to reduce the likelihood of the protuberances collapsing when the cable is tensioned. This proposal has proved expensive to manufacture and unreliable due to the ball bearings being pushed out of the protuberances. There is also a need to displace the central wire to locate each ball bearing. In some cable bolts the central wire is replaced by a hollow tube which extends along the centre of the cable. Other disadvantages relate to the difficulty in automating the placement of the ball bearings and the ball bearing creates a stress concentration on the strands of the cable creating loads that lead to failure loads up to 25% less than the original strands ultimate tensile strength.

In our earlier Australian patent application 2008200918 we disclose a cable bolt having a hollow strand which facilitates the passage of grout along the cable. It is important that the hollow strand does not get crushed by radial loads in non collapsible protrusions.

It is these issues that have brought about the present invention.

SUMMARY

According to one aspect of the present invention there is provided a cable bolt comprising a plurality of flexible steel filaments formed around a central member, the cable bolt having spaced bulbous portions along the length of the bolt each bulbous portion defining a cavity containing a segmented ring that surrounds the central member to engage the filaments of the bulbous portion.

In accordance with a further aspect of the present invention there is provided a method of manufacturing a cable having twisted flexible steel filaments over a central member, the method comprising forcing the filaments apart without plastically deforming the filaments, inserting a spacer through the parted filaments to sit between the filaments and the central member, and releasing the parted filaments to return against the spacer to form a bulbous portion.

In one form, the filaments are forced apart by applying torsion to the filaments. In one form, the torsion is applied over a length of the cable to form bulbous portions spaced along the cable.

In one form, in addition to or instead of, the filaments are forced apart by inserting a spreading tool between the filaments.

In one form, the spacer extends around the central member. In a particular form, the spacer is a segmented ring that is placed in pieces through the parted filaments and formed into a ring surrounding the central member. In another form, the spacer may be a unitary element, such as helical wound member that is rotated onto the inner member through the parted filaments.

In one form the torsion and/or spreading is applied over a section of the pre-wound cable to open the outer filaments over a set length to allow insertion of the ring segments around the central member before releasing the filaments forming a permanent non-collapsible single protrusion. The process may be repeated further along the pre-wound cable.

In a further aspect of the present invention, there is provided an apparatus for forming bulbs in a cable having twisted flexible steel filaments over a central member, the apparatus comprising:

a bulbing assembly releasably engagable with said cable, said assembly being operative to force the filaments apart without plastically deforming the filaments; and an inserting device operative to insert a spacer through the parted filaments to sit between the filaments and the central member.

In use on releasing the parted filaments they return against the spacer to form a bulbous portion in the cable.

In one form, the apparatus further comprises a frame; and a securing device for holding at least a portion of a cable with respect to frame.

In one form the cable is fed through the bulbing assembly so that a plurality of bulbing portions are able to be formed along the cable.

In another form, the bulbing assembly is movable relative to the apparatus frame to form spaced apart bulbing portions in the cable. Typically in this latter arrangement the cable remains stationary during forming of the plurality of bulbs but in another form, the cable may be moved so that both the cable and the bulbing apparatus move during bulb forming.

In one form, the apparatus includes a feed assembly to feed the cable from a coil into the apparatus. In one form the cable, with bulbs formed therein, is progressed to a table and the apparatus further includes a cutting device to cut the cable to length as required in formation of cable bolts.

BRIEF DESCRIPTION OF DRAWINGS

An embodiment of the present invention will now be described by way of example only with reference to the accompanying drawings in which.

DETAILED DESCRIPTION

Figure 1:
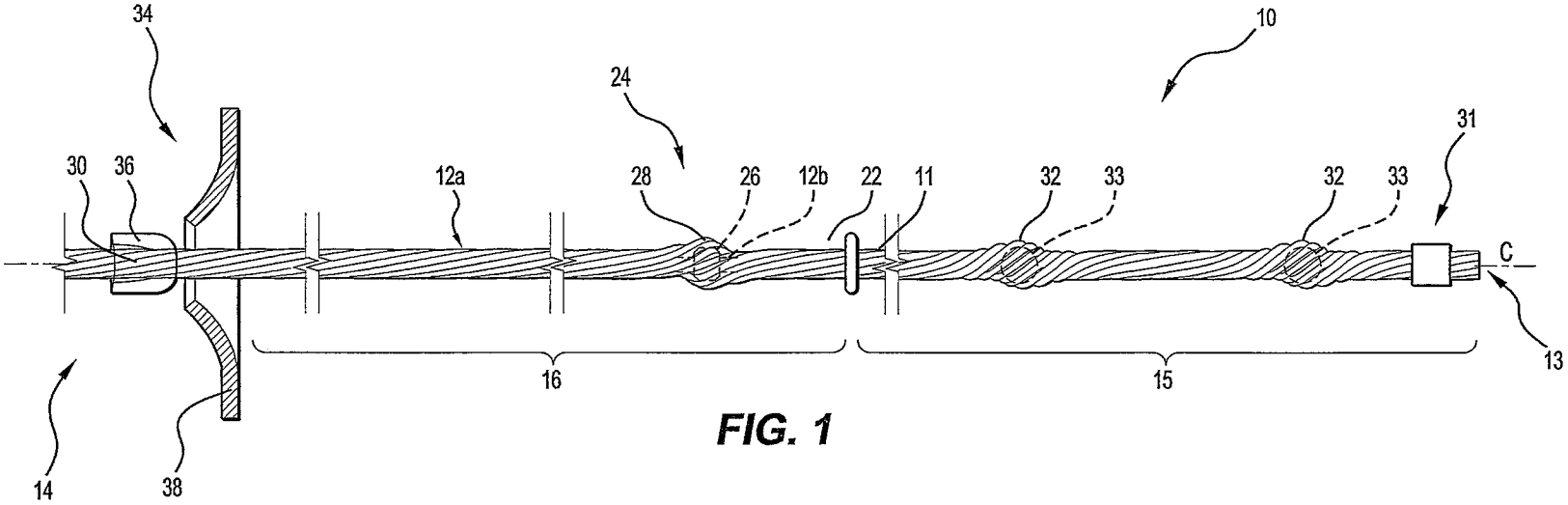
FIG. 1 is a part sectioned side view of a typical cable bolt.
Figure 2:
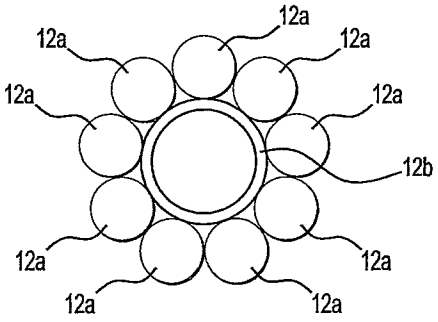
FIG. 2 is a cross sectional view of the cable bolt.

FIGS. 1 and 2 illustrate a cable bolt 10. These drawings are taken from our earlier Australian patent application 2008200918, corresponding to U.S. Pat. No. 8,322,950, incorporated herein by reference.

As illustrated in FIG. 1, an embodiment of a resin anchorable cable bolt 10 comprises a flexible cable 11 formed from a plurality of wound co-extending strands in the form of wound co-extending steel filaments that extends along an axis C between opposite ends (being, relative to the direction the bolt 10 is installed in a bore in a substrate, such as a mine shaft roof, a distal end 13 and a proximal end 14). The cable 11 has a first portion 15 adapted primarily for resin point anchoring, and a second portion 16 adapted predominantly for cement grouting.

As illustrated in FIG. 2, the filaments comprise nine outer steel filaments 12*a* spiral wound about a central hollow filament, or strand 12*b*, located axially within the cable 11. In one form, the hollow strand 12*b* may comprise at least one region for resisting radial compression, in particular of a tensioning assembly which is discussed in more detail below. In alternative arrangements, the hollow strand 12*b* may be plain, and/or more or fewer outer steel filaments 12*a* may be used, in which case their relative diameter with respect to the hollow strand 12*b* would be adjusted accordingly such that they are close fitting about the hollow strand 12*b*. The outer steel filaments, or strands, 12*a* are typically solid and of the type used for cable bolt or pre-stressed concrete applications. The hollow strand 12*b* extends in the second portion 16 and not in the first portion 15, however in alternative embodiments, the hollow strand may extend into the first portion 15 also.

In the embodiment of FIG. 1, the central hollow strand 12*b* comprises profiling allowing flexibility of the cable 11, while providing strength to resist crushing of the strand (i.e. radial compression of the cable). The hollow strand 12*b* is flexible to allow coiling of the cable 11 such that the coil has a minimum diameter of 1.2 m without kinking the hollow strand 12*b*. In alternative embodiments, the minimum coiling diameter without kinking the hollow strand may fall within the range of 0.8 m to 2.5 m, or 1 m to 2 m. In the embodiment illustrated in FIG. 1, the profiling is in the form of a helical or spiral ribs 17 (see FIG. 7) along its entire length. The hollow strand 12*b* is formed from a metal material, in this embodiment steel, but may be formed from a polymeric material, such as polypropylene, a polyethylene, or other appropriate polymer.

Referring again to FIG. 1, the cable bolt 10 further comprises a resin retainer 22 disposed between the first and second portions 15, 16 of the cable 11. The resin retainer 22 is affixed to the cable 11 and extends radially outwardly from the cable so as to substantially reduce the migration of resin from the first portion to the second portion within the bore during point anchoring of the bolt 10. The resin retainer is typically formed from metal, however may be formed from any suitable polymer such as polypropylene or a polyethylene.

The hollow strand 12*b* is located in the second portion 16 of the cable bolt 10 and extends from the proximal end 14 of the cable 11 to a location 24 in the second portion 16 at or adjacent the retainer 22. As illustrated in FIG. 1, a nut 26 is located on or near the hollow strand 12*b* at location 24 within the outer filaments 12*a*, forming a bulb, or "nut cage" 28. The nut cage is formed by spacing apart and forcing outwardly all of the steel filaments 12 along a discrete section of the cable 11 and placing the nut 26 about the hollow strand end 24.

The first portion 15 includes an end collar 31 for holding together the strands 12*a* at the distal end 13, and a plurality (three in the illustrated case) of radially outwardly extending resin mixing protrusions in the form of "bird cages" 32, where a ball bearing (or other rigid object) is inserted in a partially unwound portion of strands 12*a*.

It is desirable in some instances to form bulbs along the second portion 16 (in addition to the first portion 15) and/or to extend the hollow strand 12*b* into the first portion 16. As such it is desirable to be able to form bulbs about the hollow strand 12*b*. Further to facilitate manufacturing processes, it is desirable that the bulbs are formed without unwinding of the steel filaments.

FIGS. 3 to 6 illustrate an apparatus for forming non collapsible spaced protrusions (or bulbs) 18 about the hollow strand 12*b* of the flexible cable 11. These bulbs 18 incorporate a segmented ring 40 (FIG. 7) that prevents collapse of the bulb 18 whilst ensuring against radial compression of the hollow strand 12*b*.

Figure 3:
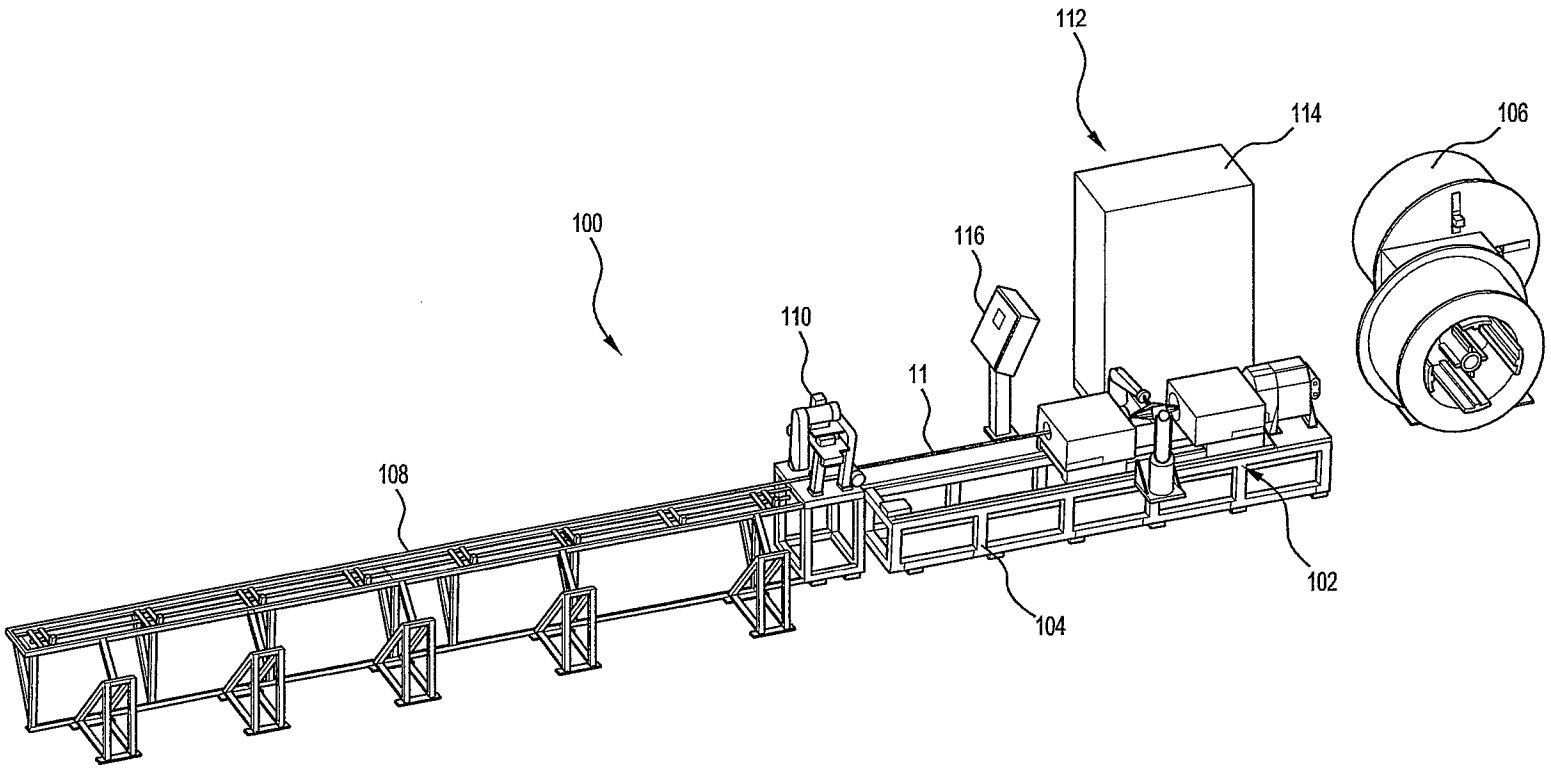
FIG. 3 is a schematic view of an apparatus for forming bulbs in a cable in accordance with an embodiment of this invention.
Figure 4:
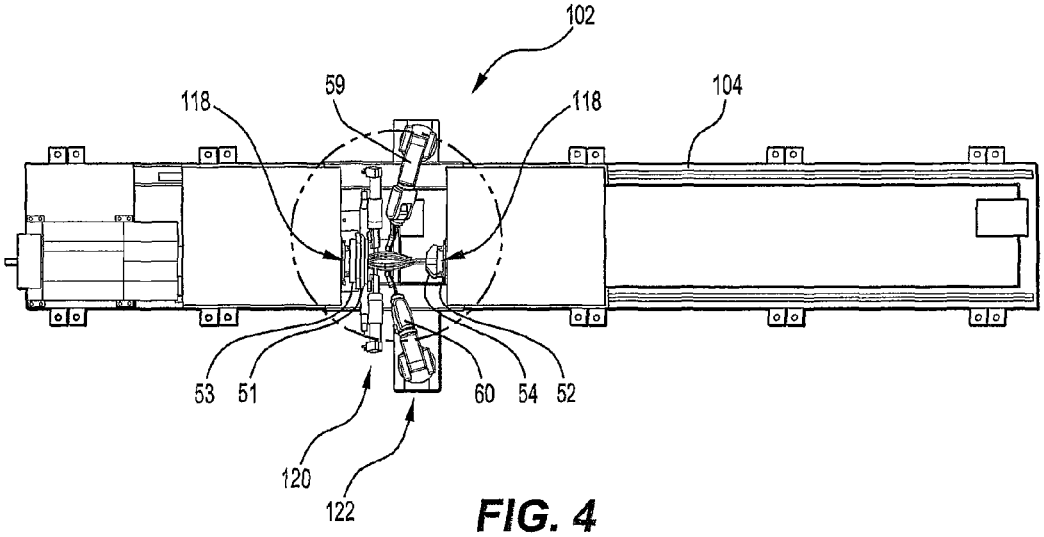
FIG. 4 is a plan view of a bulbing apparatus of the apparatus of FIG. 3.
Figure 5:
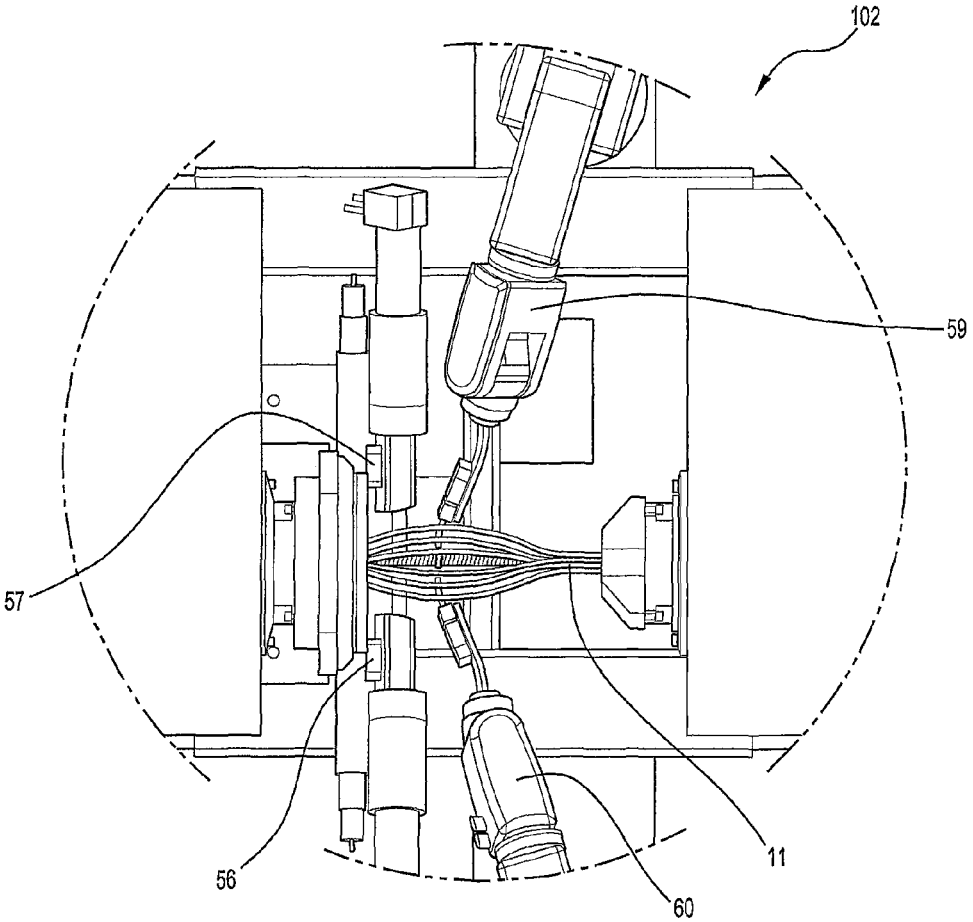
FIG. 5 is a detailed view of the bulbing apparatus of FIG. 4.

The method of forming the bulbs 18 and locating the segmenting ring 20 is discussed with particular reference to the bulbing apparatus 100 shown FIGS. 3 to 5.

As best shown in FIG. 3, the apparatus 100 includes a bulbing assembly 102 mounted on a frame 104. A cable 11 is arranged to be fed from a coil (not shown) mounted within a coil handler 106. Once bulbs are formed in the cable 11 (as discussed in more detail below) by the bulbing assembly 102, the cable is progressed to a payout table 108. A cutting device 110 is disposed between the frame 104 and the payout table 108 and is arranged to cut the cable once a desired length (typically of 8 m but it may be more or less depending on requirements) is passed onto to the table. The cut lengths of cable can then be further processed to form the final cable bolts as required. The bulbing process is preferably fully automated and controlled by a control system 112 which may include, as illustrated, a control cabinet 114 and operator interface 116.

As best shown in FIGS. 4 and 5, bulbing assembly 102 includes three components; namely torsioning device 118, spreader 120, and inserter 122. In general, the torsioning device 118 is designed to twist the cable bolt 10 to force the filaments 12*a* apart to define a gap. The spreader 120 (shown in the form as a pair of plates or knives 56,57) is designed to further spread adjacent filaments that allows the inserter 122 adequate space to enable the segmented ring 40 to pass through the parted filaments 12*a* to be located in an interfitting arrangement on the central strand 12*b*.

In the illustrated embodiment, the torsioning device 118 discloses the use of mandrels 51, 52 positioned around the cable 11 at spaced intervals to define a length of cable as shown in FIGS. 4 and 5. Each mandrel 51 or 52 includes a three jaw chuck 53, 54 which can be brought into clamped engagement with the periphery of the cable 11. The chucks 53, 54 are clamped to the cable and are either rotated in opposite directions or one is rotated relative to the other to place the filaments 12*a* of the cable into torsion which has the effect of parting the filaments 12*a* and forming a protrusion 18 at the mid span of cable between the chucks 53, 54. With the chucks 53, 54 held in position to maintain the torsion, spreader knives 56, 57 are pushed between selected parted filaments 12*a* and rotated to further move the filaments apart. This provides access to the inserter 122 (in the form of robotic arms 59, 60) which place segments 41, 42 of the ring 40 on opposite sides of the hollow strand 12*b* and then fitted together as shown in FIGS. 6 and 7.

Figure 6:
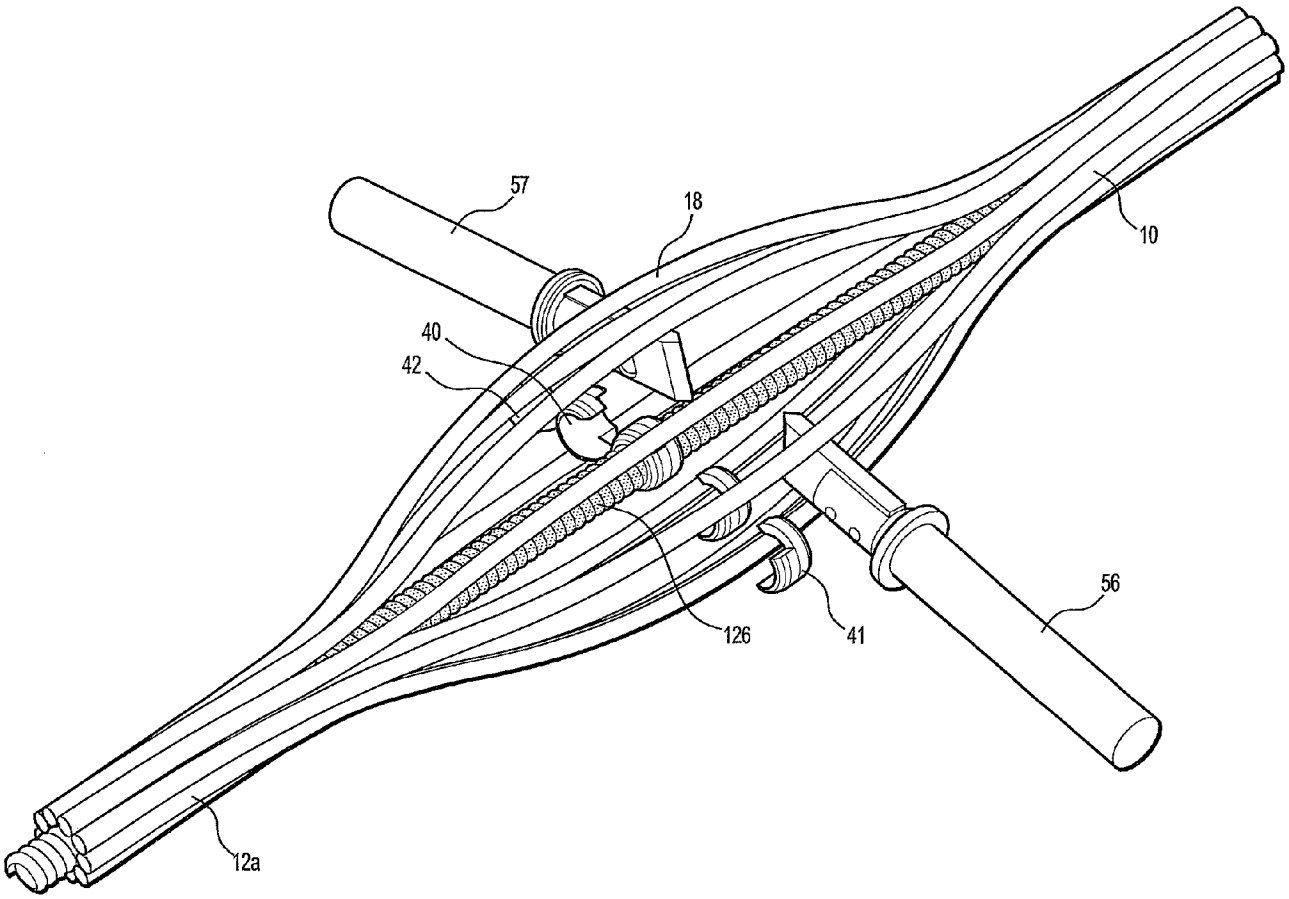
FIG. 6 is a perspective view of the bulb illustrating insertion of a segmented ring. For convenience components of the bulbing apparatus are not shown.
Figure 7:
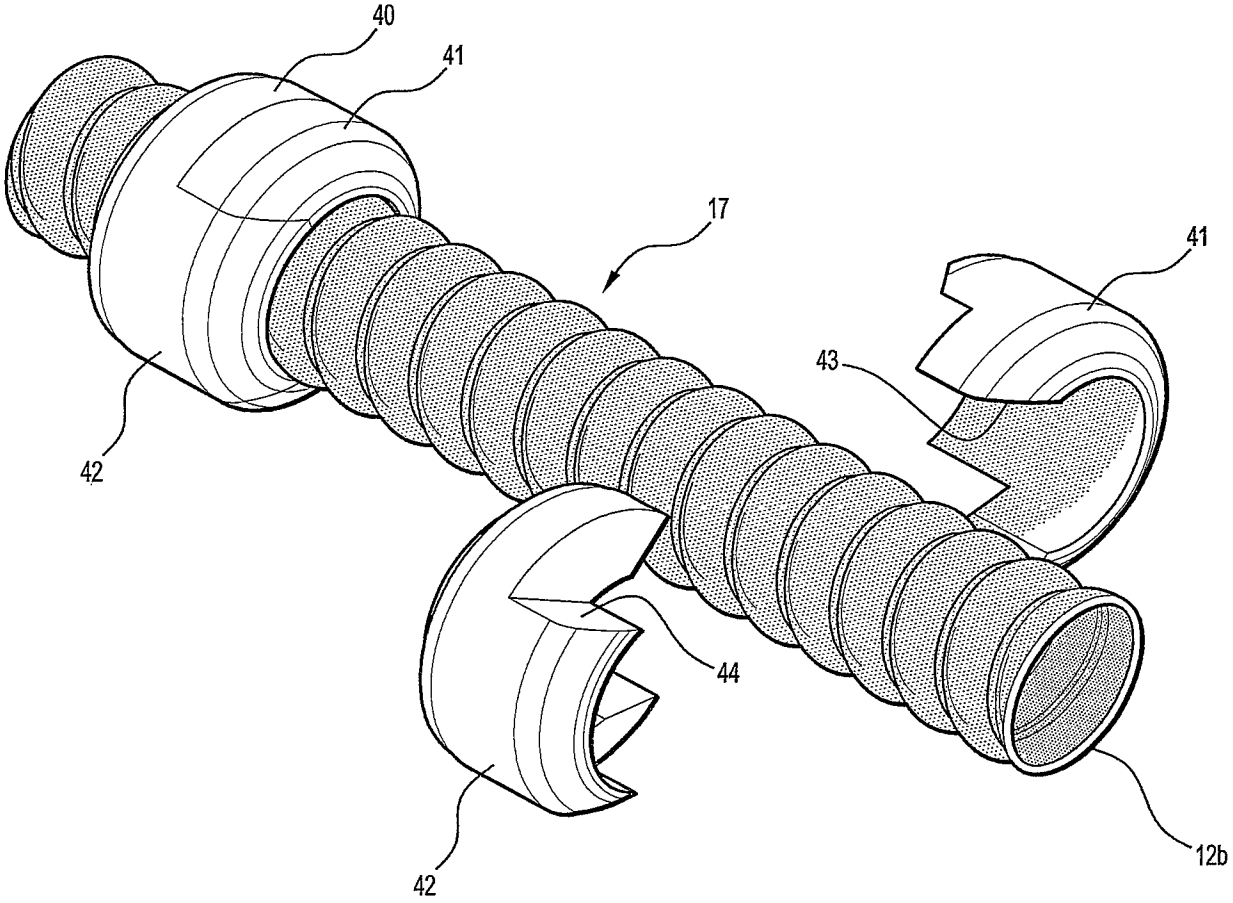
FIG. 7 is a perspective view illustrating the location of the segmented ring on a central strand of the cable bolt.

As shown in FIG. 7, each ring segment 41, 42 has a projection 43 that is a snug fit within a similarly profiled recess 44 on the other segment 42 of the ring to allow the segments 41, 42 to form a circular one piece ring 40 as shown in the left hand side of FIG. 6. Once the ring 40 has been placed on the central strand 12*b* the knives 56, 57 can be removed and, the torsion applied by the mandrels 51, 52 can be released causing the parted filaments 12*a* to close onto the periphery of the ring 40 thereby locating the ring 40 in the cavity of each protrusion 18 on the central strand 12*b*. By a steady release of the torsional load the parted gap between the filaments closes and the filaments 12*a* contact the ring 40 to form an expanded non-collapsible bulb 18.

The location of the ring 40 on the hollow central strand 12*b* ensures that when the cable bolt is tensioned the protrusion 18 does not collapse. The segmented ring 40, by forming a single annular ring ensures that there is no danger of the segments 41, 42 crushing the central strand 12*b*. The dovetailed inter fitting of the segments 41, 42 ensure that radial forces on the ring 40 are evenly distributed around the periphery of the strand 12*b*. The segmented ring 40 whilst preventing radial collapse of the strand 12*b* can also allow a degree of movement between the strand 12*b* and ring 40 thus maintaining the flexibility of the final cable.

In the form illustrated, the torsional and spreading forces that are placed on the cable bolt as it is twisted through use of the mandrels 51, 52 and spreader 120 is insufficient to cause plastic deformation of the wire filaments 12*a*.

Once the bulb 18 is formed, the cable 11 can then be fed through the bulbing assembly 102 (in a direction towards the payout table 108) such a subsequent portion of the cable 11 aligns with the bulbing assembly. The bulbing assembly is then able to form a further bulb 18 in the cable allowing separate spaced bulbs 18 to be formed in the cable 11.

In an alternative form, the bulbing assembly may be designed to move along the length of the cable 11 to form spaced apart bulbs in the cable 11. In either process, in this manner the cable 11 can have non collapsible grouting protrusions (in the form of bulbs 18) at desired intervals along the length of the cable 11.

This process can be completed off a reel and wound back into smaller reels; or to cut to lengths. Alternatively, the process can use precut lengths.

It is also envisaged that the mandrels 51, 52 and chucks 53, 54 may be split to facilitate attachment to the cable 10 without the need to pass the cable through the mandrels and chucks.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of manufacturing a cable having twisted flexible steel filaments over a central member, the method comprising forcing the filaments apart without plastically deforming the filaments, inserting a spacer through the parted filaments to sit between the filaments and the central member, and releasing the parted filaments to return on their own accord against the spacer to form a bulbous portion, wherein the central member remains in an original position throughout the method of manufacturing the cable and wherein the spacer is provided around the central member at an intermediate position between a proximal end of the central member and a distal end of the central member.

2. The method according to claim 1 comprising applying torsion over a length of the cable to force the filaments apart.

3. The method according to claim 2, wherein the torsion is applied at spaced apart locations on the cable and the filaments are forced apart between those spaced apart locations.

4. The method of according to claim 1, comprising inserting a spreader between adjacent filaments to force the filaments apart.

5. The method according to claim 1 comprising inserting the spacer in the form of components of a segmented ring through the parted filaments and forming a closed ring over the central member.

* * * * *